United States Patent [19]

Smith

[11] Patent Number: 4,479,647

[45] Date of Patent: Oct. 30, 1984

[54] RESISTANCE EXERCISER

[76] Inventor: Robert S. Smith, 1263 Emory St., San Jose, Calif. 94126

[21] Appl. No.: 335,911

[22] Filed: Dec. 30, 1981

[51] Int. Cl.[3] ..... A63B 21/02; A63B 21/24

[52] U.S. Cl. ..... 272/117; 272/125; 272/71; 272/DIG. 5; 272/129; 273/55 R

[58] Field of Search ..... 272/133–136, 272/142, 125, 126, 129, 116–118; 73/379–381; 254/343

[56] References Cited

U.S. PATENT DOCUMENTS

| | | | |
|---|---|---|---|
| 3,532,189 | 10/1970 | Wade | 272/133 |
| 3,836,121 | 9/1974 | Jones | 254/343 |
| 3,902,480 | 10/1975 | Wilson | 272/129 |
| 3,998,431 | 12/1976 | Fawcett | 254/343 |
| 4,114,875 | 9/1978 | Deluty | 272/133 |
| 4,138,106 | 2/1979 | Bradley | 272/129 |
| 4,235,437 | 11/1980 | Ruis et al. | 272/130 |

*Primary Examiner*—Richard C. Pinkham
*Assistant Examiner*—MaryAnn Stoll
*Attorney, Agent, or Firm*—Alan H. MacPherson; Steven F. Caserza; Terrence E. Dooher

[57] ABSTRACT

Exercise apparatus has a handle attached to a cable which is extended when tension on the cable exceeds a preset value. A release allows the cable to be moved effortlessly to the starting position of the exercise. The cable is retracted when the cable is slack, and the cable is clamped at a desired position and a signal emitted when the tension in the cable exceeds a preset value. The exercise apparatus has an isometric mode which allows a force to be applied to the cable without motion of the cable.

10 Claims, 10 Drawing Figures

RESISTANCE EXERCISER

BACKGROUND OF THE INVENTION

1. Field of the Invention

This invention relates to an exercise apparatus that operates in both an isotonic mode and an isometric mode. In the isotonic mode the apparatus provides preset resistance in a controlled range of motion.

2. Description of the Prior Art

Many prior art devices are available for practicing resistance exercises, including such devices as barbells and weight machines in which the exerciser performs a variety of constrained motions by pushing or pulling on bars, handles attached to cables, or similar structures. In other types of exercising devices, the resistance is provided by springs, or hydraulic or pneumatic pressure. Still another approach is to pull a rope through a device which applies frictional resistance to the motion of the rope. Exercises performed with each of the above devices are referred to as isotonic because they are performed over a range of motion.

Another type of exercise where force is applied but no motion occurs, is referred to as isometric. Examples of isometric exercises include standing on one end of a rope and pulling on the other end, or grasping a rope in both hands and pulling the rope. When performing this type of isometric exercise, a tension measuring device may be attached to the rope to provide an indication of the effort exerted by the exerciser.

The usefulness of a particular exercise device is determined among other things by the variety of exercises that can be performed, the range of resistance that can be applied, mode of exercise (i.e. isometric or isotonic), cost, control of speed of motion, durability, convenience of location and overall weight.

It will be obvious in light of the teachings of this specification that this invention combines all of these factors to provide a significant improvement over prior art exercise devices.

SUMMARY

In accordance with this invention an exercise machine is provided which includes an electrically controlled means for locating with negligible first predetermined resistance $F_1$ a bar or handle attached to one or more cables at any desired position in preparation for exercise. The structure of this invention allows exercise to be performed isotonically by pulling against the bar or handle with a force such that no motion of the bar or handle occurs unless the force exceeds a second preset value $F_2$. In accordance with a feature of this invention, after the bar or handle, and thus the cable has been pulled, the structure of this invention causes the cables to be automatically retracted once the cables become slack, although no perceptible retraction force is exerted as long as the cables are held slightly taut by the exerciser.

In accordance with another feature of this invention, the structure of this invention provides means for clamping the cables to prevent their movement in order that isometric exercises can be performed at any preset handle position. During isometric exercises, the structure of this invention provides a signal (e.g. a light or a bell) which is emitted when the exercise tension applied to the cables exceeds the present value $F_2$.

In one embodiment of this invention, the electrically controlled means for locating is contained in a housing with one or more cables emerging from the top of the housing. A bar is attached to the cables enabling the performer to exercise by standing on the top of the housing and grasping and applying force to the bar attached to the cables.

In another embodiment of this invention, the cables emerge from a housing and are attached to the waist of a swimmer.

In another embodiment of this invention, the cables emerge from the housing and are attached to the waist of a runner.

DETAILED DESCRIPTION

Figure 1:
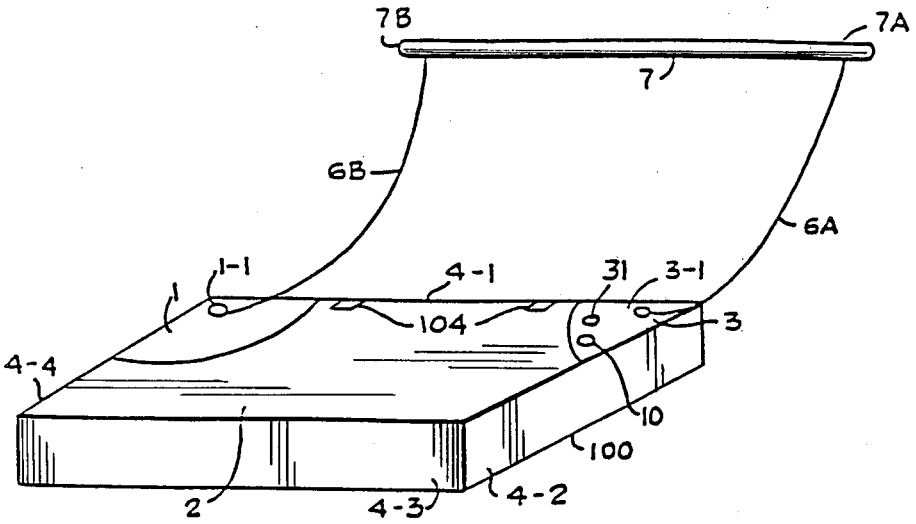
FIG. 1 presents one embodiment of this invention in which is shown a platform with two cables 6*a*, 6*b* emerging from two sides 4–2 and 4—4 of the platform and attached to the ends of bar 7.

FIG. 1 shown a platform 101 of convenient size which, in the embodiment of FIG. 1 forms the top side of a box or housing 100. A convenient size for many purposes is a box one foot high by two feet deep by four feet wide. However these dimensions can be varied as appropriate and are not critical. The platform 101 is divided into three sections 1, 2 and 3. Sections 1 and 3 are rigidly fastened to sides 4–1, 4—4 and 4–1, 4–2, respectively of box 100 while section 2 is hinged (via hinges 104) along side 4–1. One end 6*b* of a cable 6 emerges from a hole 1—1 in section 1 while the other end 6*a* of cable 6 emerges from a hole 3–1 in section 3. The cable ends are attached to the ends 7*a* and 7*b* of bar 7.

Figure 2:
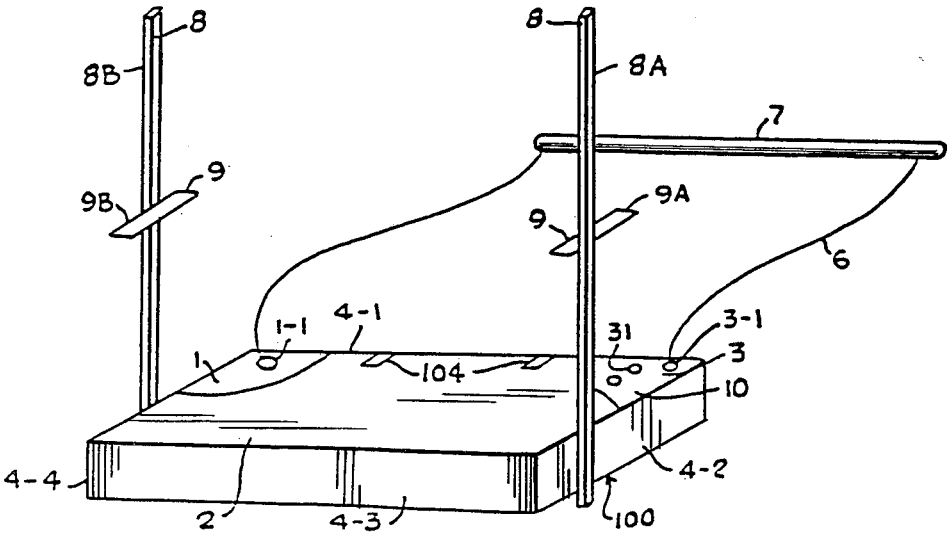
FIG. 2 depicts the structure of FIG. 1 in which two upright supports have been added.

FIG. 2 shows a second embodiment of this invention which is similar to the embodiment of FIG. 1 and which includes upright supports 8*a* and 8*b* fixed at each end of platform 101. Cross supports 9*a* and 9*b* are clamped at any desired height on the upright supports 8*a* and 8*b* to support the bar 7 and thereby to establish the starting position of the exercise. A foot switch 10 in the platform 101 releases the cable 6 allowing the bar 7 to be set at any desired height to start the exercise. A second foot switch 31 establishes the mode of exercise as either isometric or isotonic, as desired.

Figure 3:
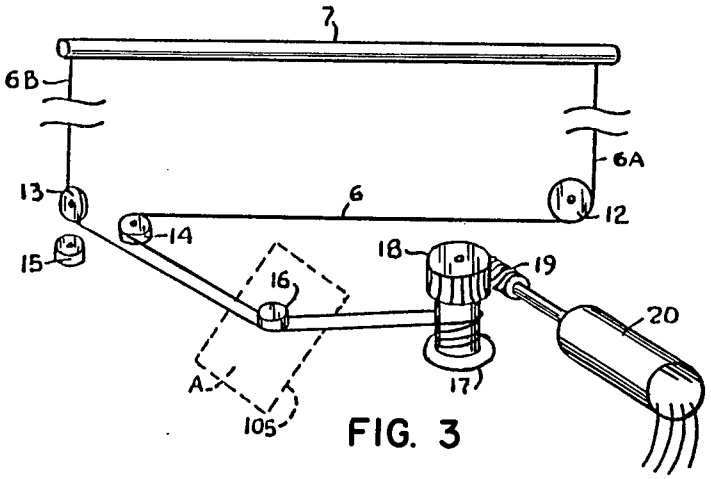
FIG. 3 shows the arrangement of the cables within the housing for the embodiments shown in FIGS. 1 and 2.

FIG. 3 shows the layout of the cable 6 inside the box 100. Pulley 12 directs end 6a of cable 6 to pulleys 14 and 15 and pulley 13 directs end 6b of cable 6 to pulleys 14 and 15. Pulleys 14 and 15 direct the doubled cable to pulley 16. Pulley 16 is mounted on a sensing mechanism not shown in FIG. 3 but described later and shown in detail in FIG. 4. Still referring to FIG. 3, the two ends 6a and 6b of cable, after combining and passing over pulley 16 are wrapped around capstan 17. Capstan 17 (which could be replaced by a winch or any other appropriate structure) is driven through worm gear 18 by a worm 19. Worm gear 18 and worm 19 brake capstan 17 when not being used to rotate capstan 17 in one or the other direction. The sensing mechanism shown in FIG. 4 can do several different things, namely, (1) cause the worm to wind the cable 6 up on the capstan 17 when the cable is slack;

(2) cause the worm 19 to unwind the cable from capstan 17 allowing one to raise the bar 7 when applying a force equal to or grater than a predetermined slight force $F_1$, or when applying a force that exceeds a larger preset force $F_2$, as desired, or;

(3) cause the worm 19 to be stationary and thereby lock the cable 6 for isometric exercises or when tension in the cable is insufficient to turn on the unwinding means, i.e., when the force exerted on the bar by the performer is less than, or equal to the preset value $F_2$, but greater than or equal to the predetermined value $F_1$.

Figure 4:
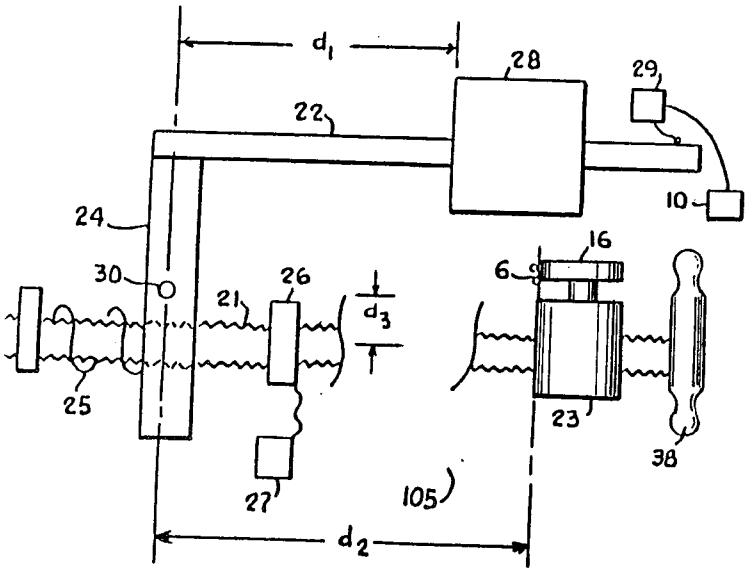
FIG. 4 shows in detail the control mechanism within dotted line enclosure A of FIG. 3.

The sensing mechanism 105 on which pulley 16 is mounted is located within the dotted enclosure A of FIG. 3 and shown in detail in FIG. 4. Sensing mechanism 105 includes rectangular rod 22 located above and parallel to threaded rod 21. Rod 21 passes through a tapped hole in block 23, with pulley 16 being mounted on block 23. Rod 21 also passes through a clearance hole (i.e. an unthreaded hole through which threaded rod 21 can slide with negligible resistance) in bar 24 which is attached (typically by welding) to rod 22. Rod 21 is positioned with respect to block 24 by a spring 25 mounted on the rod 21 on one side of bar 24 and by a keeper nut 26 on the other side of bar 24, as shown. Thus, when tension is applied to the cable 6 about pulley 16, threaded rod 21 slides in the direction of arrow 21a through the clearance hole in block 24, thereby compressing spring 25. When tension on the cable 6 is released, spring 25 returns the rod 21 to its original position.

When rod 21 slides in the direction of arrow 21a and thus compresses spring 25 due to tension in cable 6, rewind switch 27 is switched from the "slack" position (i.e. when cable 6 is slackened) to the "taut" position (i.e. when cable is taut) by contact with keeper nut 26. The spring 25 is selected and the keeper nut 26 is positioned on rod 21 with respect to switch 27 so that a slight tension in the cable 6 caused by the performer exerting a very small force equal to (or greater than) $F_1$ on bar 7 causes keeper nut 26 to move switch 27 to the "taut" position. When rewind switch 27 is in the slack position, worm 19 (FIG. 3) is turned by motor 20 to wind the cable 6 up on capstan 17 (FIG. 3) until the cable 6 is slightly taut, whereupon rewind switch 27 (FIG. 4) switches to the "taut" position and the worm 19 stops turning. Rectangular rod 22 is fixed, for example by welding, to block 24 as shown. Block 24 is pivotally mounted on pin 30 which is rigidly attached to the frame (not shown) of the apparatus. Bar 22 fits into a groove in sliding weight 28. When sufficient tension is applied to the cable about pulley 16, the assembly (rods 21, 22 and bar 24) pivits about pin 30 so as to switch the "lift" switch 29, located at one end of bar 22. This operation of lift switch 29 causes the worm 19 to turn and unwind the cable 6 from the capstan 17 (FIG. 3). The amount of tension in the cable 6 (and thus the force $F_2$ on the bar 7) required to unwind the cable 6 is determined by the distance d1 between sliding weight 28 and pin 30, as well as by the distance d2 between block 23 and pin 30 and the distance d3 between the pin 30 and the centerline of rod 21. The position of block 23 is changed by turning knob 38 which rotates the threaded rod 21 and causes block 23 to move linearly along rod 21, thus changing distance d2.

A "position" switch 10 (shown in FIGS. 1, 2, 4, 6 and 7) is connected such that if slight tension is applied to the cable 6 (thereby switching switch 27 to taut position) and position switch 10 is simultaneously closed, the cable will unwind, thus allowing positioning of the bar 7 (FIGS. 1 and 2) with only slight resistance. In one embodiment, position switch 10 is a foot operated switch located on the platform 101 as shown in FIG. 2.

Also located in the platform 101 (for example, as a foot switch similar to switch 10, previously described) is a "mode" switch 31 which is used to switch the equipment to either the isometric mode or the isotonic mode (see FIGS. 1 and 2). In the isometric mode, switch 31 causes lift switch 29 to be disconnected from capstan motor 20 and connected to an isometric timer (not shown in FIG. 4 but described later), and cable 6 to be locked in a fixed position (since capstan motor 20 is disconnected).

Figure 5:
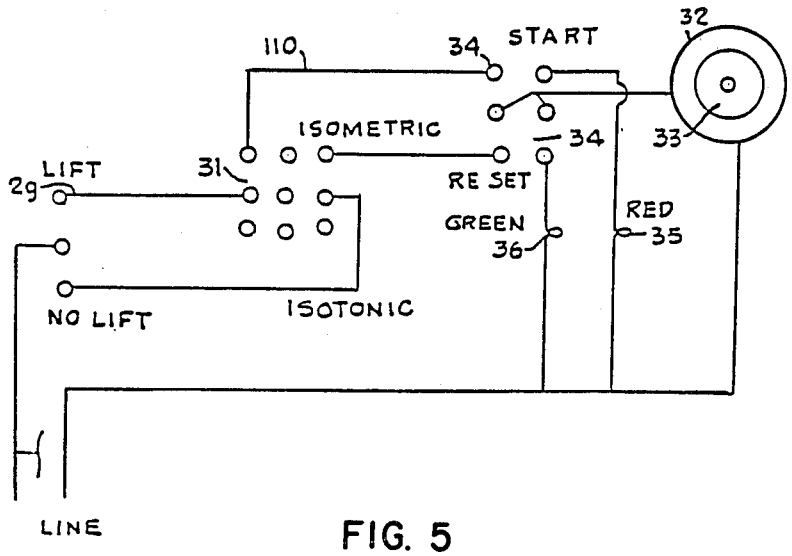
FIG. 5 shows one embodiment of the tension sensing and timing circuitry used during the isometric mode of exercise.

Referring now to FIG. 5, there is presented one embodiment of an isometric timer 110 for defining the length of time of each isometric exercise. Isometric timer 110 includes timer motor 32 with cam 33 mounted on the shaft of timer motor 32. In one embodiment, cam 33 is a disk with two removable screws (not shown) on its periphery, with the screws serving as lobes causing switch 34 to operate as cam 33 is rotated and with the angular separation of the two screws defining the isometric timing interval. If switch 34 is in the reset condition when the mode switch 31 is first switched to isometric and switch 29 is in the "no lift" position, the green light 36 will come on indicating that the timer motor 32 is turning so as to switch 34 to start. At this point, the motor 32 and lights 36 are both off. When the exerciser exerts force in excess of preset value $F_2$ causing switch 29 to switch turn on. Motor 32 turns until the cam causes switch 34 to reset at which time the red light goes off. When the cable goes slack, switch 29 switches to no lift causing the green light to come on (signaling completion of the lift cycle) and the motor to drive switch 34 back to start, ready for the next exertion. If the exerciser reduces applied force below $F_2$ during the lift cycle, the timer motor and red light turn off until the exerciser applies force exceeding $F_2$ causing the motor and red light to turn on again.

In light of the teachings of this specification, it is obvious to those skilled in the art that other circuits could be devised which, operated in conjunction with a lift switch and mode switch as described above, would perform similar or related services for the user.

When the mode switch 31 is switched to the isotonic position, the lift switch 29 is connected into the wind-unwind circuitry (not shown in FIG. 5). The function of this wind-unwind circuitry is to provide the wind-unwind functions described above, i.e. unwind cable 6 from capstan 17 when strong tension is applied to cable 6 in excess of the preset value $F_2$, wind cable 6 onto capstan 17 when the cable 6 is slack, and maintain cable 6 in position when tension caused by a force on bar 7 between the predetermined value $F_1$ and preset value $F_2$ is applied to cable 6, and unwind cable 6 where a force greater than or equal to $F_1$ is applied to cable 6 by bar 7 and position switch 10 is closed.

Figure 6:
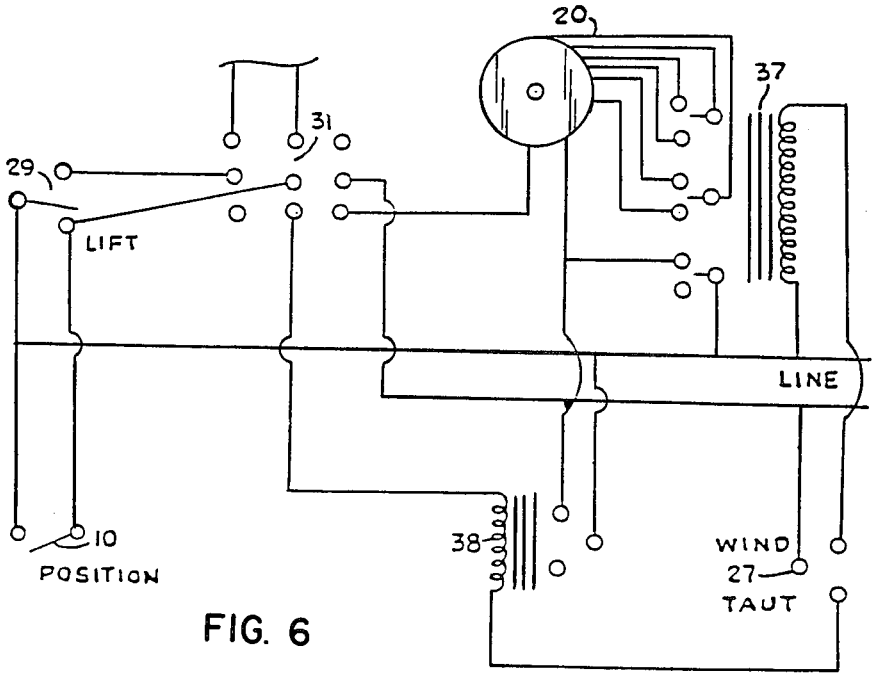
FIG. 6 shows one embodiment of the electrical means for sensing tension, establishing direction of wind or rewind, and exercise mode selection.

One embodiment of the wind-unwind circuitry of this invention is shown in FIG. 6. When rewind switch 27 is in the wind position, (i.e. cable 6 is slack) three pole double throw relay 37, connected to the windings of capstan motor 20, turns on capstan motor 20 so as to wind the cable 6 up on capstan 17. When the cable 6 becomes sufficiently taut so as to cause rewind switch 27 (FIG. 4) to be moved to the taut position, relay 37 is turned off. When relay 37 is off, power to the capstan motor 20 is disconnected thereby causing capstan motor 20 to stop and thereby locking the cable 6 fixed. By the operation of relay 37, power connections to the windings of capstan motor 20 are now reversed so that if cable 6 is pulled taut enough (i.e. by exerting a force greater than or equal to the preset value set by adjusting the position of weight 28 on rod 22 and/or turning control knob 38), lift switch 29 is moved to the lift position, thereby connecting relay windings 38 in series with rewind switch 27 (which is in the taut position), thereby activating single pole single throw relay 38. Capstan motor 20 thereby turns on so as to unwind the cable 6 from the capstan 17.

Position switch 10 is connected in parallel with lift switch 29 thus providing that if the cable 6 is taut (i.e. switch 27 in the taut position), and position switch 10 is closed (i.e. by the performer indicating that a change in the height of bar 7 against negligible resistance is desired), the cable will unwind, enabling the bar 7 to be positioned by the performer exerting a very small force $F_1$ on the bar sufficient to maintain switch 27 in the taut position.

Figure 7:
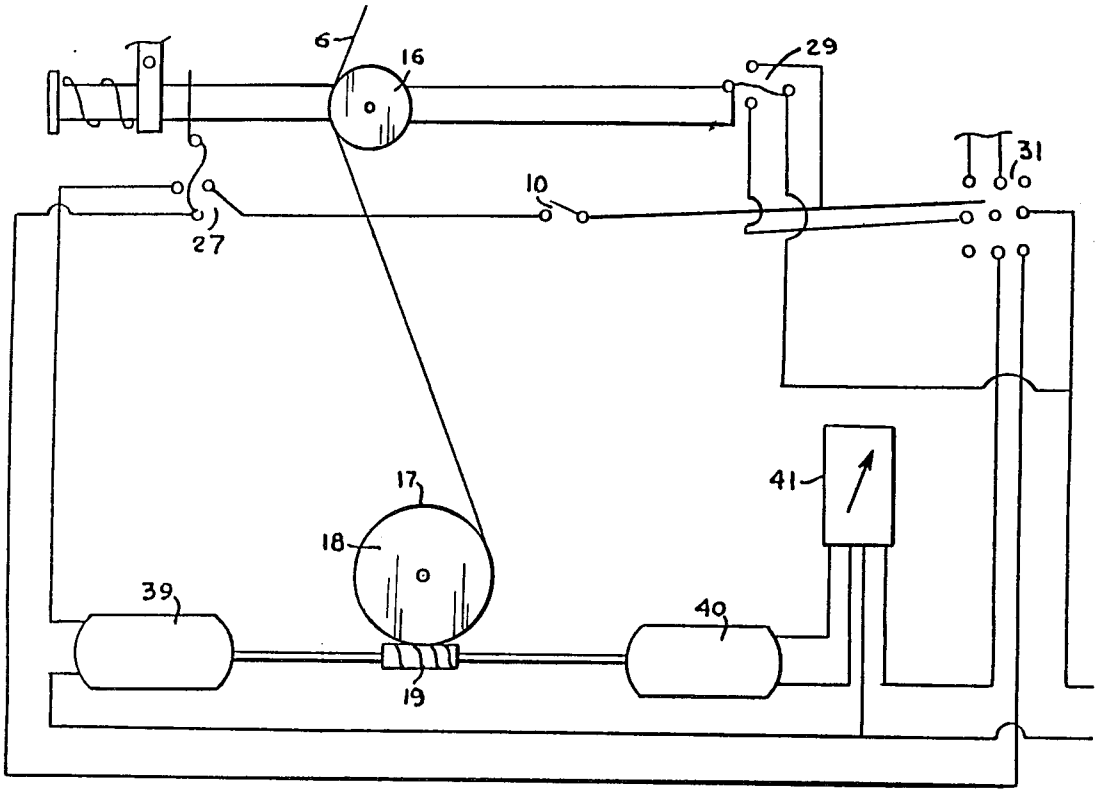
FIG. 7 shows a second embodiment of said electrical means for sensing tension, establishing direction of wind or rewind, and exercise mode selection.

Another embodiment of the wind-rewind circuitry of this invention is shown in FIG. 7. Worm 19 is driven either by wind motor 39 or by unwind motor 40. If desired, either one or both the wind and unwind motors 39, 40 are connected to a source of power through a speed controller, thus allowing the winding and unwinding of cable 6 on capstan 17 at a selected one of a large number of possible speeds. In FIG. 7, speed controller 41 is shown connected between a source of power and unwind motor 40. When mode switch 31 is set in the isotonic mode, lift switch 29 controls the unwind motor 40. When force exceeding $F_2$ is applied through cable 6, it causes switch 29 to be set in the lift position, and motor 40 unwinds the cable 6 from capstan 17. Conversely, when the cable 6 is slack, wind switch 27 closes to the slack position thus causing wind motor 39 to operate to wind up the cable 6 on capstan 17, thus removing the slack from cable 6.

If slight force $F_1$ is maintained, the cable thereby moving switch 27 to the taut position, and position switch 10 is simultaneously closed, wind motor 40 will turn on, allowing the bar to be positioned with little resistance.

One problem associated with the use of capstan motor 20 (FIG. 6) and wind and unwind motors 39, 40 (FIG. 7) is that under some conditions of usage the motors are required to very suddenly reverse their direction of rotation. In order to reduce the rather large surge currents that occur with some motors due to this sudden reversal of the direction of rotation, a number of solutions are available, which are suitable for use in both the embodiments of FIGS. 6 and 7. One means to minimize the surge current is to use a so-called "instant reversing motor" for motors 20 (FIG. 6), 39 and 49 (FIG. 7). These motors are manufactured by General Electric. They are more expensive than other types of motors, such as the split phase capacitor start motor and the universal AC-DC motor.

Another means to minimize the surge current is to encapsulate spring 25 (FIG. 4) in a damping medium such as silicone putty (for example, the widely known Silly Putty ® material, or a heavy grease), which dampens the motion of spring 25 so as to slow the movement of rod 21 as it goes from the lift mode to the rewind mode, thereby giving the motor 20 (in the embodiment of FIG. 6) and motors 39 and 40 (in the embodiment of FIG. 7) time to stop before reversing. Typically, it is desirable to provide a minimum of approximately 100 milliseconds between motor rotation in one direction and motor rotation in the opposite direction.

Still another means to minimize surge currents is to attach to the worm shaft a brake (not shown) which brakes the worm shaft when no power is applied to the motors 20, 39, 40. However, although brakes are well known to those of ordinary skill in the mechanical arts, the use of brakes is rather expensive.

Figure 8:
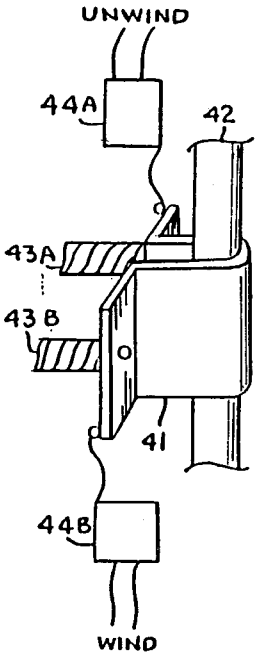
FIG. 8 shows a motor protection device for reducing surge currents.

Yet another means to minimize surge currents is the use of a "rotation detector" on the worm shaft. Such a rotation detector prevents application of power to cause the winding action so long as the worm shaft is turning in the unwind direction, and vice versa. Referring to FIG. 8, rotation detector 120 is shown in which a band 41 is held astride the worm shaft 42 by opposing anchor springs 43*a* and 43*b*. When the worm shaft 42 rotates in the clockwise direction (as indicated by the arrow and corresponding to the winding of cable 6 on to capstan 17), friction causes the band 41 to tend to rotate with worm shaft 42 thereby switching motion switch 44*b* which thereby prevents power from being applied to the timer motor 20 (FIG. 6) or unwind motor 40 (FIG. 7) thus preventing the counter-clockwise drive of worm shaft 42 (corresponding to the unwinding of cable 6 from capstan 17) until the clockwise rotation of worm shaft 42 has ceased. Conversely, when worm shaft 42 rotates in the counter-clockwise (i.e. unwind) direction, the band 41 tends to rotate with worm shaft 42 thereby switching motion switch 44*a* which thereby prevents power from being applied to the timer motor 20 (FIG. 6) or the wind motor 39 (FIG. 7) thus preventing the clockwise drive of worm shaft 42 until the counter-clockwise rotation of worm shaft 42 has ceased. In this manner, surge currents are minimized.

The embodiments of this invention described above include the use of capstan 17 which winds, unwinds or clamps the cable 6, as desired. It is emphasized that means other than capstan 17 provide additional embodiments of this invention. For example, in FIG. 9 another embodiment of this invention is shown, which includes threaded rod 45 which is supported at one end by a bearing 46 held in a fixed support 47. Threaded rod 45 is coupled at its other end to a reversible motor 48. The rod 45 is threaded through a movable support 49 with pulleys 50A and 50B being mounted on movable support 49. The ends of two cables, 51A and 51B are anchored on fixed support 47 as shown. The cables 51A and 51B pass around pulleys 50A and 50B, respectively, and then around fixed pulleys 52A and 52B, respectively. The two cables 51A and 51B then pass on to a tension sensing mechanism (not shown), such as the tension sensing mechanisms previously described in the foregoing paragraphs, and are in turn connected to a handle, also as described in the previous embodiments.

Figure 9:
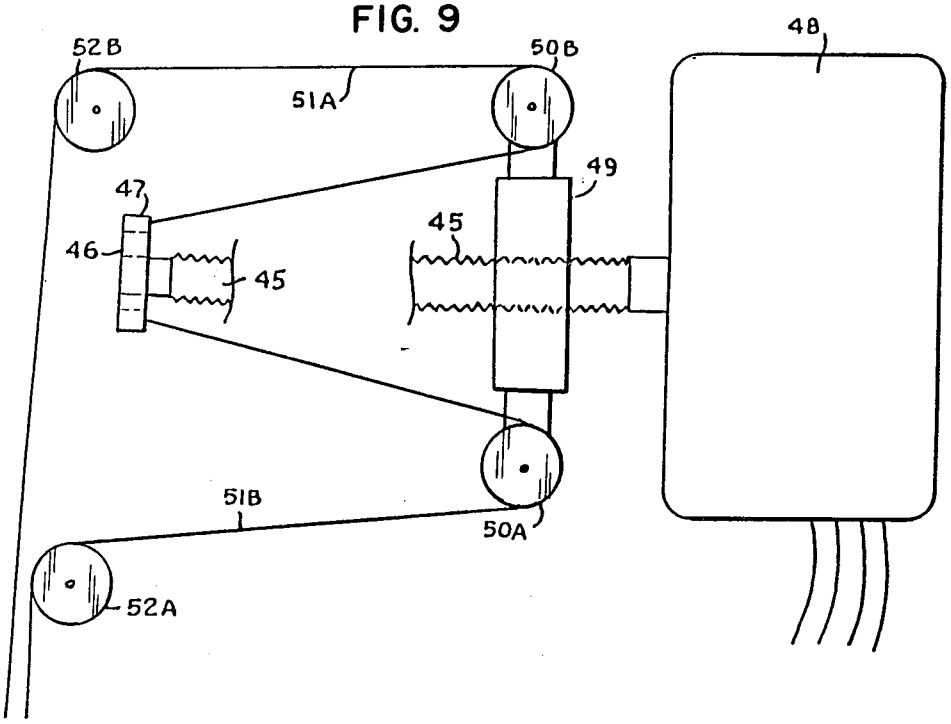
FIG. 9 shows a second embodiment of the means for retracting and allowing extension of the movable member.

When the tension on the cables 51A, 51B exceeds a preset value, the motor 48 turns on and the movable support 49 moves toward stationary support 47, thereby causing the cables 51A, 51B to "play out", which is analogous to the unwind operation of the previously described embodiments. When the cables 51A, 51B are slack, the motor 48 turns on in the opposite direction causing the movable support 49 to move away from fixed support 47 and thus retracting cables 51A, 51B which is analogous to the wind operation of the previously described embodiments. When the motor 48 is not turning, the threaded rod 45 prevents movement of (i.e. "locks") the cables 51A, 51B. The embodiment of FIG. 9 is suitable for use with a low cost motor 48, such as the universal AC-DC type which is, if desired, powered by an inexpensive speed controller of well known design (not shown). Furthermore, the embodiment of FIG. 9 provides a substantial reduction in the cost of gearing as compared with the embodiments of FIGS. 3 and 7 which utilize the worm drive worm gear-capstan structure.

Figure 10:
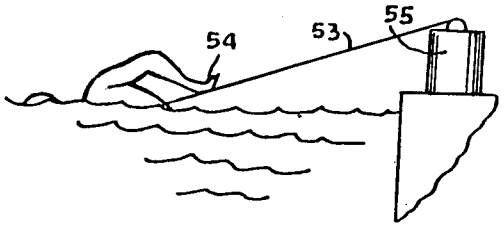
FIG. 10 shows an embodiment of the invention adapted for swimmers.

In the above described embodiments of this invention, the use of the tension sensing and wind-unwind circuitry was described in conjunction with a platform upon which the exercise performer stood or laid to perform his exercise routine. It is obvious to those of ordinary skill in the art, in light of the teachings of this invention, that other embodiments can be easily designed in which the cable emerging from the wind-unwind means is arranged to accommodate exercise routines unique to a particular sport. For example, referring to FIG. 10, an embodiment of this invention is shown providing a cable 53 having one end attached to the waist of a swimmer 54 and its other end emerging from the tension controlling mechanism 55. The use of the device for swimmers constitutes a considerable improvement over such prior art means as kickboards, which are presently used to provide added resistance to swimmers. Similarly yet another embodiment of this invention (not shown in the drawings) provides a cable attached to the back of the waist of a runner such as a football lineman to strengthen his charge.

The above descriptions are meant to be illustrative only and are not limiting. Other embodiments of this invention will be obvious to those skilled in the art of designing exercise machines in view of the above disclosure.

I claim:

1. A structure for assisting a person to perform exercises comprising:

a movable member;

means, coupled to said movable member, for retracting and for allowing the extension of said movable member; and means, including a release mechanism, for controlling said means for retracting and for allowing the extension of said movable member such that said movable member is (i) extended when both a force equal to or greater than a very slight predetermined force $F_1$ is applied thereto and said release mechanism is simultaneously activated, (ii) held fixed when both a force equal to or greater than $F_1$ and less than or equal to a second force $F_2$ preselected independently of $F_1$ and larger than $F_1$ is applied thereto and said release mechanism is not activated, (iii) extended when both a force greater than $F_2$ is applied thereto and said release mechanism is not activated, and (iv) retracted when a force less than $F_1$ is applied thereto wherein said means for controlling further comprises:

a mode selection means having a first isotonic mode and a second isometric mode, and signal means such that when said mode selection means is in said first isotonic mode said means for controlling operates as in (i)-(iv) and when said mode selection means is in said second isometric mode (a) said movable means is held fixed when a force is applied thereto, and (b) said signal means emits a signal so long as the force applied to said movable member exceeds said preselected force $F_2$ and the total time said applied force exceeds $F_2$ is less than a preselected time period.

2. Structure as in claim 1 wherein said means for retracting and for allowing extension comprises cable means;

a capstan;

reversible motor means including a motor shaft; and means for coupling said capstan to said reversible motor means;

so that said cable means is retracted by winding said cable means on said capstan and said cable means is allowed to be extended by unwinding said cable means from said capstan.

3. Structure as in claim 2 wherein said reversible motor means comprises a first motor which, when energized, causes said capstan to rotate in a first direction of rotation and a second motor which, when energized, causes said capstan to rotate in a second direction of rotation opposite said first direction of rotation.

4. Structure as in claim 2 wherein said means for coupling comprises a worm wheel affixed on said capstan and a worm gear affixed on said motor shaft, wherein said worm gear and worm wheel serve as a brake on said capstan when power is not applied to said reversible motor means, thereby holding said cable means fixed.

5. Structure as in claim 1 wherein said means for retracting and for allowing extension comprises:

a fixed support;

a first and a second cable attached to said fixed support;

a movable support having a threaded hole;

a rotatable pully means attached to said movable support for rotably passing said first and said second cable;

means for rotating a rod; and a threaded rod having a first end and a second end, said first end being attached to said fixed support, said second end being coupled to said means for rotating, said threaded rod being threaded through said threaded hole of said movable support, and said first and said second cable being rotably tensioned by said movable support such that said movable support moves in a first linear direction toward said fixed support in response to the rotation of said threaded rod in a first direction of rotation so that said first and said second cables are allowed to be extended, said movable support moves in a second linear direction opposite said first linear direction in response to the rotation of said threaded rod in a second direction of rotation opposite said first direction of rotation so that said first and said second cables are retracted, and said movable support holds said first and said second cables fixed when said threaded rod is not rotated.

6. A structure for assisting a person to perform exercises comprising:

a movable member;

means, coupled to said movable member, for retracting and for allowing the extension of said movable member, said means comprising cable means, a capstan, reversible motor means including a motor shaft, and means for coupling said capstan to said reversible motor means, so that said cable means is retracted by winding said cable means on said capstan and said cable means is allowed to be extended by unwinding said cable means from said capstan;

means for controlling said means for retracting and for allowing the extension of said movable member, said means for controlling comprising a release mechanism, a pivot block which is rotatably mounted about a pivot axis, said pivot block having a pivot block through-hole aligned perpendicular to said pivot axis such that the center line of said through-hole is displaced from said axis, a sliding rod means having a portion slidable mounted within said pivot block through-hole, bias means for establishing the rest position of said sliding rod means relative to said pivot block, a first slidable block capable of being secured at a desired position along the length of said sliding rod means, a fixed rod connected to said pivot block and substantially parallel to said sliding rod means, a second slidable block capable of being secured at a desired position along the length of said fixed rod, means for transmitting force from said cable means to said first slidable block, wherein as the tension in said cable means increases, said slidable rod slides with respect to said pivot block in opposition to the force supplied by said bias means, and wherein, as said tension in said cable means increases, said cable means rotates said sliding rod means, said fixed rod, said first and second sliding blocks, and said pivot block about said pivot axis, a first switch means having a first position when said slidable rod means is in a position corresponding to tension on said cable means caused by a force less than a first predetermined force $F_1$ and having a second position when said slidable rod means is moved to a position corresponding to tension on said cable means caused by a force greater than or equal to $F_1$, a second switch means having a first position when said fixed rod is in a position corresponding to a force on the cable means less than a second predetermined force $F_2$ larger than $F_1$ and a second position when said fixed rod is rotated sufficiently about said pivot axis due to a tension on said cable means caused by a force greater than $F_2$, wherein said cable means is retracted when said first switch is in said first position and said second switch is in said first position, said cable means is held fixed when said first switch is in said second position and said second switch is in said first position, and said cable means is allowed to be extended when said first switch is in said second position and said second switch is in said second position, so that said movable member is (i) extended when both a force equal to or greater than said predetermined force $F_1$ is applied thereto and said release mechanism is simultaneously activated, (ii) held fixed when both a force equal to or greater than $F_1$ and less than or equal to said second predetermined force $F_2$ is applied thereto and said release mechanism is not activated, (iii) extended when both a force greater than $F_2$ is applied thereto and said release mechanism is not activated, and (iv) retracted when a force less than $F_1$ is applied thereto.

7. Structure as in claim 6 wherein said release mechanism comprises a third switch in parallel with said second switch for allowing extension of said movable member when said third switch is closed and a force equal to or greater than $F_1$ is applied to said movable member.

8. Structure as in claim 1 wherein said signal means includes a timer which indicates when a force exceeding $F_2$ has been applied for a total length of time equal to a preselected time period.

9. Structure as in claim 6 wherein said bias means comprises a spring.

10. Structure as in claim 9 wherein said spring is damped by a viscous material thereby causing said reversible motor means to stop rotating before being caused to rotate in the opposite direction.

* * * * *